US005400612A

United States Patent [19]

Hedges

[11] Patent Number: 5,400,612

[45] Date of Patent: Mar. 28, 1995

[54] HIGH HUMIDITY-LOW TEMPERATURE PORTABLE STORAGE APPARATUS

[75] Inventor: James Hedges, Tavernier, Fla.

[73] Assignee: Louisa A. Timme, Tavernier, Fla.

[21] Appl. No.: 68,406

[22] Filed: May 27, 1993

[51] Int. Cl.[6] ..... F25D 17/04

[52] U.S. Cl. ..... 62/171; 62/91; 62/309; 62/176.4

[58] Field of Search ..... 62/91, 457.9, 457.1, 62/309, 176.4, 171, 121

[56] References Cited

U.S. PATENT DOCUMENTS

| | | | |
|---|---|---|---|
| Re. 27,457 | 8/1972 | Rath | 62/91 X |
| 1,510,340 | 9/1924 | Pauls | 62/171 X |
| 1,861,158 | 5/1932 | Hilger | 62/171 X |
| 1,936,432 | 11/1933 | Hoffman | 62/171 X |
| 2,133,039 | 10/1938 | Philipp | 62/91 |
| 2,828,761 | 4/1958 | Weibert, Jr. | 62/171 X |

FOREIGN PATENT DOCUMENTS

| | | | |
|---|---|---|---|
| 1011214 | 10/1954 | Germany | 454/337 |

*Primary Examiner*—William E. Wayner
*Attorney, Agent, or Firm*—Frank L. Kubler

[57] ABSTRACT

An apparatus for storing items includes a housing sized to be portable and including a storage compartment for receiving the items, and a mechanism for refrigerating and humidifying the storage compartment joined to the housing. The housing is preferably a cabinet having a having a storage compartment access door and a compartment for retaining at least part of the mechanism for refrigerating and humidifying the storage compartment. A duct is preferably provided for delivering the air streams into the storage compartment. The mechanism for refrigerating and humidifying including a vessel containing water, a wick structure extending above and into the water, a first fan for creating an air stream toward the wick structure, a first electric circuit for delivering electric power to the first fan, a second fan for creating an air stream over the surface of the water, a second electric circuit for delivering electric power to the second fan, and a mechanism for cooling the water. The mechanism for cooling the water preferably includes a coolant compressor, an evaporator manifold in fluid communication with the compressor, a condenser manifold in fluid communication with the compressor and in thermal communication with the water, and a third electric circuit for delivering electric power to the compressor.

16 Claims, 3 Drawing Sheets

HIGH HUMIDITY-LOW TEMPERATURE PORTABLE STORAGE APPARATUS

BACKGROUND OF THE INVENTION

1. Field of the Invention

The present invention relates generally to the field of controlled environment storage devices, and more specifically to a portable storage unit containing interactive humidification and refrigeration means for storing cigars, flowers, or other items, including a housing having an item access door, and containing a storage compartment for retaining the stored items and an apparatus compartment for retaining the cooling and humidification assembly, the assembly including a reservoir vessel containing water and a first fan mounted above the water and a water wick structure extending out of the water in front of the first fan so that an air stream is delivered across the saturated wick structure to gather moisture, and including a duct for delivering the fan-propelled air stream into the storage compartment, a coolant compressor thermally isolated from the reservoir by a compartment partition, a condenser manifold secured to the housing exterior for discharging heat and an evaporator manifold extending into the reservoir water for cooling the water, both in fluid communication with the compressor, and a second fan mounted just above the cooled water for blowing air across the water surface to deliver cooled air through the duct and into the storage compartment, a first fan power switch operated by a humidity sensor in the storage compartment and a second fan power switch operated by a thermostat submerged in the reservoir water, the thermostat and humidity sensor both being set by the user to optimum storage environment conditions.

2. Description of the Prior Art

There have long been storage devices and compartments for retaining and preserving perishable items in controlled environments. Household refrigerators and ice chests keep food items cool or frozen while thermos bottles may keep hot drinks or soups warm. Commercial warehouses and retail storage areas may be equipped with cooling means to preserve some varieties of produce and consumer items. Cigars, cigarettes, flowers and bottled wine have presented the need for an environment which is both cool and humid. Such an environment must be the result of intentional design because refrigeration ordinarily dehumidifies air. Humidification devices in general have included evaporative air coolers such as industrial cooling towers, where cooling is the primary objective and humidification is largely incidental. Devices designed specifically for humidification generally heat incoming air to provide the latent heat of evaporation. See McGraw-Hill Encyclopedia of Science and Technology, volume 8, pages 545–547.

Cigar storage rooms have been provided for distributive commercial and retail use and in a few cases have been made available to private users. These rooms typically have been humidified with a timed, on-off steam generators and monitored with hydrometers connected to alarms. They have also been equipped with cooling devices. Yet for private users there is the inconvenience of periodically traveling to the rental site to retrieve cigars, as well as continuing rental fees.

Individual cigar users have more frequently resorted to a storage device known as a humidor. A humidor is a wooden box which typically contains a moistened sponge or chemical means for releasing moisture to increase internal humidity. Such private use humidors include no means for controlling the rate of moisture release and no means for controlling the temperature level of the air inside.

It is thus an object of the present invention to provide a portable storage unit which both cools and humidifies the air inside to controlled and desired levels suited for storing and preserving items requiring such specific environmental conditions.

It is another object of the present invention to provide such a storage unit sized to fit conveniently within a room of a dwelling house or an office.

It is still another object of the present invention to provide such a storage unit which is attractive in appearance and which may assume the form of fine furniture.

It is finally an object of the present invention to provide such a storage unit which is efficient, relatively inexpensive to manufacture and maintain, and reliable.

SUMMARY OF THE INVENTION

The present invention accomplishes the above-stated objectives, as well as others, as may be determined by a fair reading and interpretation of the entire specification.

An apparatus is provided for storing items, including a housing sized to be portable and including a storage compartment for receiving the items, and a mechanism for refrigerating and humidifying the storage compartment joined to the housing.

The housing is preferably a cabinet having a storage compartment access door and a compartment for retaining at least part of the mechanism for refrigerating and humidifying the storage compartment. A duct is preferably provided for delivering air into the storage compartment. The duct preferably includes a wall extending diagonally across a vertical interior corner of the cabinet and having an air intake vent and air exit vent. The apparatus preferably additionally includes a light source inside the storage compartment activated by the opening of the door and deactivated by the closing of the door. The cabinet is preferably constructed of several layers of wood bonded together face to face.

The mechanism for refrigerating and humidifying preferably includes a vessel containing water, a wick structure extending above and into the water, a first fan for creating an air stream toward the wick structure, a first electric circuit for delivering electric power to the first fan, a second fan for creating an air stream over the surface of the water, a second electric circuit for delivering electric power to the second fan, and a mechanism for cooling the water. The mechanism for cooling the water preferably includes a coolant compressor, an evaporator manifold in fluid communication with the compressor, a condenser manifold in fluid communication with the compressor and in thermal communication with the water, and a third electric circuit for delivering electric power to the compressor. The apparatus preferably additionally includes a switch within the third circuit, and a thermostat for monitoring the temperature of the water, and adapted to operate the switch to control the temperature of the water. The apparatus preferably additionally includes a switch within the third circuit, a humidity sensor for monitoring the humidity of the air in the storage compartment and adapted to operate the switch to control the level of humidity in the storage compartment air.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
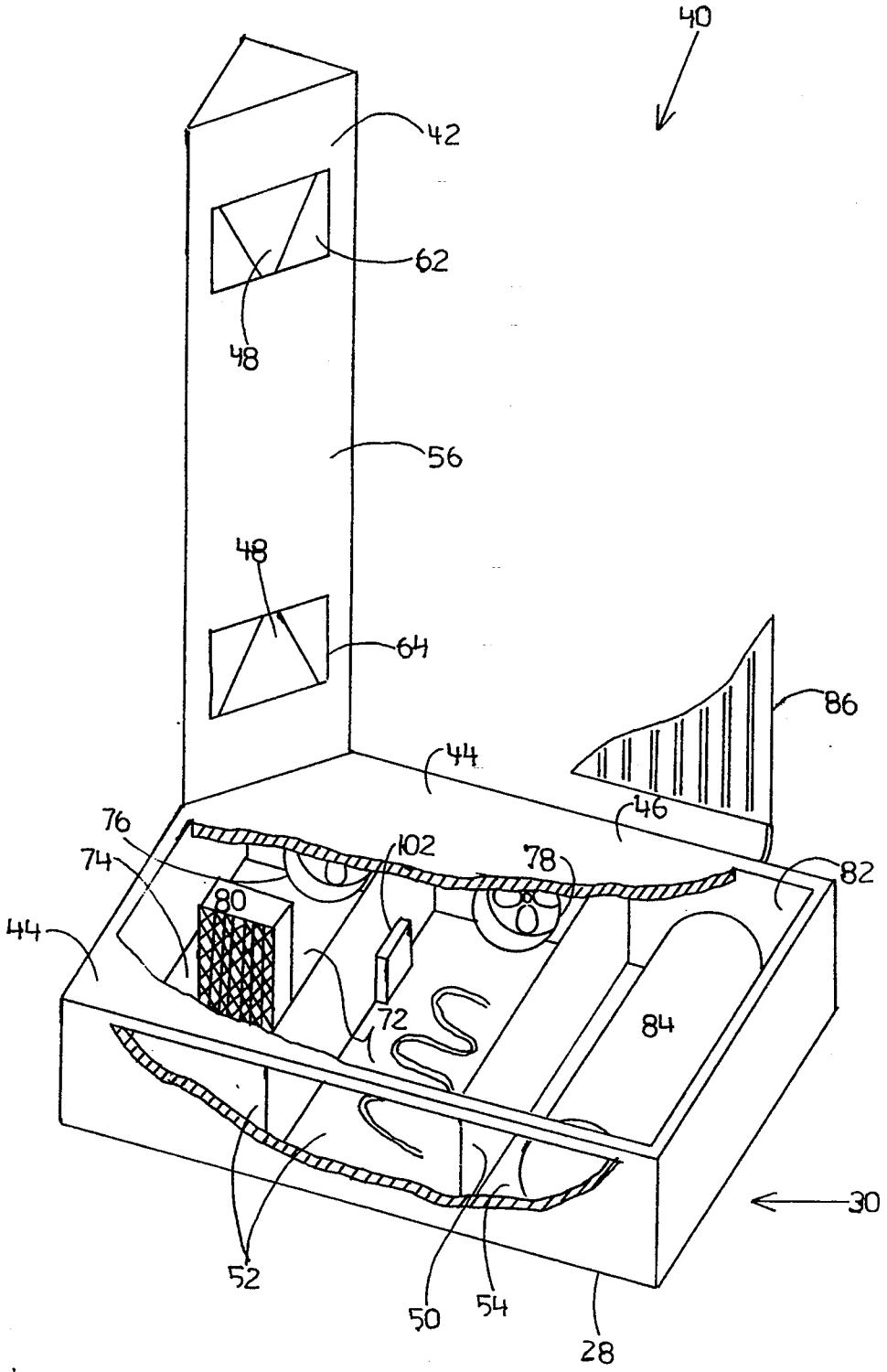
FIG. 1 is a perspective view of the cooling and humidifying apparatus and the housing apparatus compartment and diagonal vent wall of the inventive unit.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

First Preferred Embodiment

Figure 2:
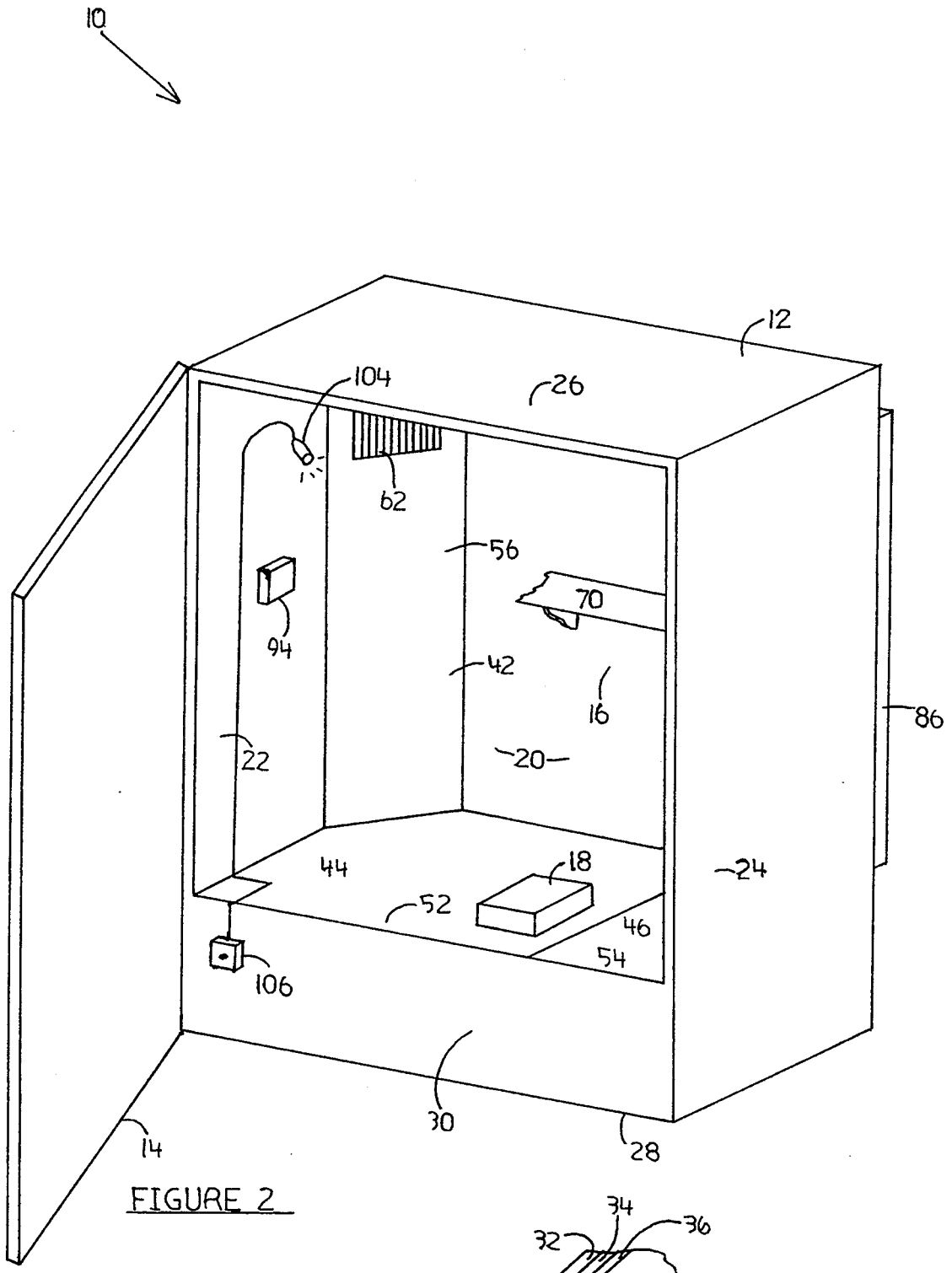
FIG. 2 is a perspective view of the complete unit with the item access door open to reveal the interior of the unit storage compartment.

Referring to FIGS. 1 and 2, a portable storage unit 10 is disclosed which includes a housing 12 containing a storage compartment 20 for retaining cigars, bottled wine, flowers or other items 18. Housing 12 also includes an apparatus compartment 30 for retaining portions of a combined humidification and cooling assembly 40. An air duct 42 delivers the cooled and humidified air from apparatus compartment 30 into storage compartment 20.

Figure 3:
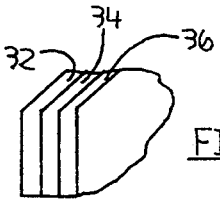
FIG. 3 is a broken away portion of the unit wall, showing the preferred three wood layers.

Housing 12 is preferably an elongate cubical structure having a front wall 14, a rear wall 16, two side walls 22 and 24, a top wall 26 and a bottom wall 28. See FIG. 2. Front wall 14 is hinged to function as a primary access door. Housing 12 is preferably constructed of layered wood, the first layer 32 forming the interior surface of housing 12 being of cedar. The middle layer 34 is plywood. Outer layer 36 is an attractive hard wood such as mahogany or oak. See FIG. 3. Layers 32, 34 and 36 are bonded together with a waterproof glue. Apparatus compartment 30 is preferably located at the lower end of housing 12. Apparatus compartment 30 is divided by a partition 50 into a reservoir section 52 and a compressor section 54. Reservoir section 52 is covered by a removable panel 44 forming part of the floor of storage compartment 20. A separate panel 46, which may or may not be removable, covers compressor section 54 and is flush with panel 44 to complete the storage compartment 20 floor. Compressor section 54 is alternatively accessed through a compressor door in housing rear wall 16.

Figure 4:
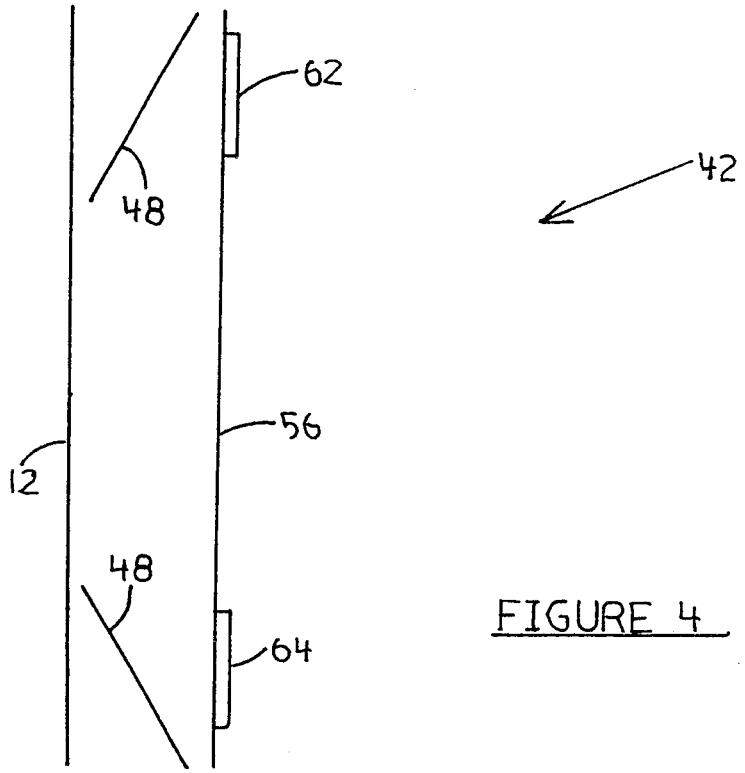
FIG. 4 is an edge view of the duct diagonal wall and deflecting panels recessed from the diagonal wall and vents.

Duct 42 is preferably formed by a vertical wall 56 extending diagonally across a rear vertical corner of housing 12. See FIG. 4. Angled deflector panels 48 guide air entering and leaving duct 42. Panels 48 are preferably recessed from wall 56 so that any condensate collecting on them drops down duct 42 into reservoir section 52. A discharge vent 62 may be provided at the upper end and an intake vent 64 provided at the lower end of duct 42. Shelves 70 for retaining stored items 18 are optionally provided in housing 12, and intermediate vents in duct 42 may discharge over each shelf 70.

The humidification portion of assembly 40 preferably includes a reservoir vessel 72 containing water 74 within reservoir section 54. First and second circulation fans 76 and 78, respectively, are mounted above the water level and side by side in a divider wall 82 of reservoir vessel 72. They are preferably propeller fans with mutually parallel and horizontal propeller axles. See FIG. 1. A water wick structure 80 extends out of the water 74 in front of first fan 76 for delivering air across wick structure 80 to gather moisture. Reservoir section 52 is accessible through storage compartment 20 by lifting panel 44, so that the water level can be checked. A site glass may alternatively be provided for this purpose.

A coolant compressor 84 is preferably provided and is thermally isolated from reservoir vessel 72 by partition 50. A condenser manifold 86 is secured to housing rear wall 16 and an evaporator manifold 90 extends into the reservoir water 74 for cooling water 74. See FIG. 1. Evaporator manifold 90 may be a coil of copper tubing or a cooling plate. Water wick structure 80 preferably rests on top of evaporator manifold 90. Second fan 78 is mounted just above cooled water 74 for blowing air across the water surface to transfer heat into water 74 and deliver cooled air through duct 42 into storage compartment 20. The air stream created by second fan 78 also gathers some moisture from the surface of water 74 to increase the humidity of air in storage compartment 20. The operation of second fan 78 thereby permits longer pauses between first fan 76 operational cycles.

A first fan power switch is operated by a humidity sensor 94 in storage compartment 20. Sensor 94 is preferably a Honeywell electronic remote humidity controller Model H 775 A. A compressor power switch is operated by a thermostat 102 submerged in reservoir water 74. Thermostat 102 is preferably a Honeywell electronic remote temperature controller of matching specification. Thermostat 102 and humidity sensor 94 are both set by the user to optimum storage environment conditions. The electrical switches may be operated by a computer program which may be contained in a ROM chip, for full automatic control.

Figure 5:
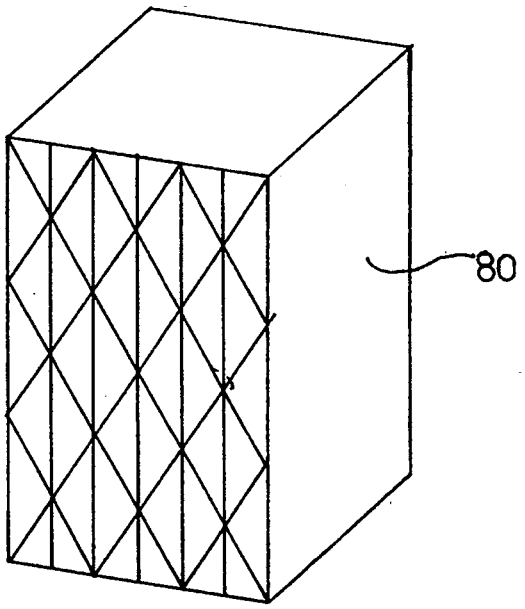
FIG. 5 is a perspective view of the preferred honeycomb wick structure.

Wick structure 80 is preferably a wide, honeycombed filter through which air can flow freely. See FIG. 5.

Optional accessories include a light source 104 in storage compartment 20 which is on a circuit operated by a switch 106 in door 14. Opening door 14 closes switch 106 to activate light source 104 and closing door 14 opens switch 106 to deactivate light source 104.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for storing items, comprising:
a housing comprising a storage compartment containing air for receiving said items,
a vessel containing humidifying liquid having a liquid surface,
means for cooling said liquid,
wick means extending into said liquid and above said liquid surface for absorbing some of said liquid and for transporting and retaining within said wick means some of said liquid above said liquid surface,
first fan means for creating an air stream above said liquid surface and toward said wick means, for refrigerating and humidifying said air within said storage compartment,
first electric circuit means for delivering electric power to said first fan means,
second fan means for creating an air stream over the surface of said liquid,
second electric circuit means for delivering electric power to said second fan means.

2. The apparatus of claim 1, wherein said housing is a cabinet having a having a storage compartment access door and a compartment for retaining at least part of said means for refrigerating and humidifying said storage compartment.

3. The apparatus of claim 2, additionally comprising a light source inside said cabinet activated by the opening of said door and deactivated by the closing of said door.

4. The apparatus of claim 2, wherein said cabinet is constructed of a plurality of layers of wood bonded together face to face.

5. The apparatus of claim 1, wherein said means for cooling said liquid comprises:
a coolant compressor,
an evaporator manifold in fluid communication with said compressor,
a condenser manifold in fluid communication with said compressor and in thermal communication with said water,
third electric circuit means for delivering electric power to said compressor.

6. The apparatus of claim of claim 5, additionally comprising:
switch means within said third circuit,
thermostat means for monitoring the temperature of said liquid, and adapted to operate said switch means to control the temperature of said liquid.

7. The apparatus of claim 5, additionally comprising:
switch means within said third circuit,
humidity sensor means for monitoring the humidity of the air in said storage compartment and adapted to operate said switch means to control the level of humidity in said storage compartment air.

8. The apparatus of claim 1, additionally comprising:
duct means for delivering said air stream into said storage compartment.

9. The apparatus of claim 8, wherein said duct means comprises a wall extending diagonally across a vertical interior corner of said storage compartment having an air intake vent and air exit vent.

10. An apparatus for storing items, comprising:
a housing sized to be portable and comprising a storage compartment for receiving said items,
and means for refrigerating and humidifying said storage compartment, joined to said housing, comprising a vessel containing humidifying liquid having a liquid surface, wick means extending into said liquid and above said liquid surface for absorbing some of said liquid and for transporting and retaining within said wick means some of said liquid above said liquid surface, first fan means for creating an air stream toward said wick means, second fan means for creating an air stream over the surface of said liquid, fan electric circuit means for delivering electric power to said first fan means and said second fan means, and means for cooling said liquid.

11. The apparatus of claim 10, wherein said means for cooling said liquid comprises:
a coolant compressor,
an evaporator manifold in fluid communication with said compressor,
a condenser manifold in fluid communication with said compressor and in thermal communication with said liquid,
compressor electric circuit means for delivering electric power to said compressor.

12. The apparatus of claim of claim 11, additionally comprising:
switch means within said compressor electric circuit means,
thermostat means for monitoring the temperature of said liquid, and adapted to operate said switch means to control the temperature of said liquid.

13. The apparatus of claim 11, additionally comprising:
switch means within said fan electric circuit means,
humidity sensor means for monitoring the humidity of the air in said storage compartment and adapted to operate said switch means to control the level of humidity in said air.

14. The apparatus of claim 10, additionally comprising:
duct means for delivering said air stream into said storage compartment.

15. The apparatus of claim 14, wherein said duct means comprises a wall extending diagonally across a vertical interior corner of said storage compartment having an air intake vent and air exit vent.

16. The apparatus of claim 1 wherein the humidifying liquid is water.

* * * * *